US006171409B1

(12) United States Patent
Hamacher et al.

(10) Patent No.: US 6,171,409 B1
(45) Date of Patent: Jan. 9, 2001

(54) PROCESS FOR THE CHEMICAL TREATMENT OF METAL SURFACES AND INSTALLATION SUITABLE THEREFOR

(75) Inventors: Matthias Hamacher, Huerth; Berhard Kotschy, Mettmann; Peter Kuhm, Hilden, all of (DE)

(73) Assignee: Henkel Kommanditgesellschaft auf Aktien

( * ) Notice: Under 35 U.S.C. 154(b), the term of this patent shall be extended for 0 days.

(21) Appl. No.: 09/356,310

(22) Filed: Jul. 16, 1999

(30) Foreign Application Priority Data

Jul. 18, 1998 (DE) ..... 198 32 424
Dec. 16, 1998 (DE) ..... 198 58 035

(51) Int. Cl.[7] ..... C23C 22/07

(52) U.S. Cl. ..... 148/253; 118/410; 118/429; 134/100.1; 134/195; 239/127; 366/163.2

(58) Field of Search ..... 148/253; 118/410, 118/429; 134/100.1, 102.1, 102.2, 195; 239/127; 366/163.2

(56) References Cited

U.S. PATENT DOCUMENTS 4,086,103 * 4/1978 Woods ..... 148/262
4,968,360 11/1990 Hosemann et al. ..... 148/253

FOREIGN PATENT DOCUMENTS 197 55 350 6/1999 (DE) .
0 228 151 7/1987 (EP) .
0 320 798 6/1989 (EP) .
0 505 606 9/1992 (EP) .

OTHER PUBLICATIONS

ASM Handbook, "vol. 5: Surface Engineering", ASM International Handbook Committee, Feb. 1996, pp. 70–78.*

* cited by examiner

*Primary Examiner*—John Sheehan
*Assistant Examiner*—Andrew L. Oltmans
(74) *Attorney, Agent, or Firm*—Wayne C. Jaeschke; Stephen D. Harper

(57) ABSTRACT

Metal surfaces are contacted with a solution of a process bath (1), for example a phosphating or pickling solution, which comprises several components in aqueous solution, the composition of the process bath (1) being maintained within a given range by addition of solutions or gases, in particular air. The profitability is improved considerably if the solution of the process bath (1) is circulated via a first line (2) and a circulating pump (3) and the solution to be added and/or the gas to be added is fed to the process bath where, as a consequence of the ending of the line (2), vigorous thorough mixing prevails, or if the solution to be added or the gas to be added is fed to a suction pump (4), the solution to be added or the gas to be added mixing with the circulated solution.

15 Claims, 2 Drawing Sheets

PROCESS FOR THE CHEMICAL TREATMENT OF METAL SURFACES AND INSTALLATION SUITABLE THEREFOR

BACKGROUND OF THE INVENTION

1. Field of the Invention

This invention relates to a process for the chemical treatment of metal surfaces, in particular for phosphating or pickling, in which the metal surfaces are contacted with a solution of a process bath which comprises several components in aqueous solution, the composition of the process bath being maintained within a given range by addition of solutions or gases, in particular air.

2. Discussion of the Related Art

In the phosphating of metal sheets, these are contacted with so-called phosphating solutions by dipping into a process bath or by spraying the solution. A very thin layer of phosphate may form on the metal surface by this means, which serves, on the one hand, to protect against corrosion and, on the other hand, to improve the adhesion of a subsequently-applied lacquer. Thicker layers of phosphate are produced if these are to serve as a forming aid to facilitate forming processes. In addition to phosphoric acid, the solution comprises chiefly zinc, so that the metal surface is covered with a zinc phosphate layer. The phosphating solution also additionally comprises further components, e.g. further metal ions, such as manganese ions, and so-called accelerators, which ensure uniform formation of the phosphate layer on the metal surface. In contrast, phosphate layers which act as slip layers are, as a rule, based on manganese phosphate.

During running use of a given phosphating solution its composition changes, so that it must be topped-up from time to time or even continuously. The conventional phosphating solutions are, as a rule, acid, the pH being about 1.5 to 4.5. If the phosphating solution comprises acid-sensitive components, such as accelerators, which decompose rapidly in the acid phosphating solution, these components must be topped-up particularly frequently. For stability reasons, the acid-sensitive components are in an alkaline solution and are metered into the acid phosphating solution with this solution. The local increase in the pH to more than 4 resulting at the dropwise addition point is a disadvantage, leading to a precipitation of zinc ions as zinc phosphate, so that zinc or zinc phosphate must also be topped-up.

This applies to a greater degree if alkaline solutions or dispersions (for example sodium hydroxide solution or sodium carbonate solution, hydroxylamine, zinc carbonate) are added to the phosphating solution to buffer the free acid. Since these alkaline solutions greatly increase the pH at the point of addition, an increased amount of zinc phosphate precipitates as a sludge. With this formation of zinc phosphate sludge, the free acid increases again, so that renewed buffering must be effected. Since the valuable material zinc phosphate is lost from the phosphating solution as a result, this valuable material must be increasingly topped-up. This increases the operating costs of the process. On the other hand, the sludge may impede the phosphating process, so that it must be removed from the phosphating bath and disposed of. This also has an adverse effect on the cost of the phosphating process. The formation of sludge is particularly pronounced if alkaline solutions are added to the phosphating bath at a point were they are mixed only slowly with the phosphating solution. The effect of the increase in the pH, and as a result the sludge formation, could be reduced by faster mixing.

However, the composition of the phosphating solution changes not only due to a reduction in the content of its components. It is also undesirable if the content of iron ions increases too much. It is known to aerate the bath to decrease the iron content. For this, compressed air is introduced via fine-pored membranes arranged in the process bath, so that the oxygen in the air oxidizes the iron ions, which then precipitate and settle on the bottom of the bath container. The fine-pored membranes having a pore width of about 20 $\mu$m produce very fine air bubbles which readily dissolve in the process bath. The consumption of the compressed air employed for the aeration, which is a significant cost factor, may be kept low by using such fine-pored membranes. However, considerable problems arise when the compressed air is switched off, since the fine membrane pores become blocked with phosphating sludge. The encrusted and blocked pores cannot be cleaned or may be cleaned only with considerable difficulty, so that, as a rule, the membranes have to be changed frequently. Furthermore, the usually high temperature of the phosphating solution, which may be up to 80° C., leads to rapid wear of the membrane units.

The problems mentioned thus lead to increased costs of the phosphating process.

Similar problems exist in the topping-up of process solutions used for pickling high-grade steel and/or titanium and alloys thereof. These are both strongly acid and oxidizing, to break up and dissolve off surface deposits and to produce a uniform metallic surface. Such process solutions are described, for example, in EP-B-505 606. To maintain the reduction-oxidation potential, it is necessary to feed in an oxidizing agent, such as hydrogen peroxide or air, continuously or discontinuously.

SUMMARY OF THE INVENTION

The present invention is therefore based on the object of considerably improving the profitability of the above-mentioned processes. Another object of the present invention is to increase the reliability of the processes, since during topping-up of individual components, the content of the other components should not be changed. These objects are achieved according to the present invention by a process for the chemical treatment of metal surfaces, in which the metal surfaces are contacted with a solution of a process bath (1), which comprises several components in aqueous solution, the composition of the process bath (1) being maintained within a given range by addition of solutions or gases, in particular air, characterized in that: the solution of the process bath (1) is circulated via a first line (2) and a circulating pump (3), and the solution to be added and/or the gas to be added is fed into the first line (2) or into the process bath at a point where, because of the end of the line (2), vigorous thorough mixing takes place, it being possible for the end of the line (2) to lie in the process bath or above the surface (10) of the process bath.

DETAILED DESCRIPTION OF THE INVENTION

Figure 3:
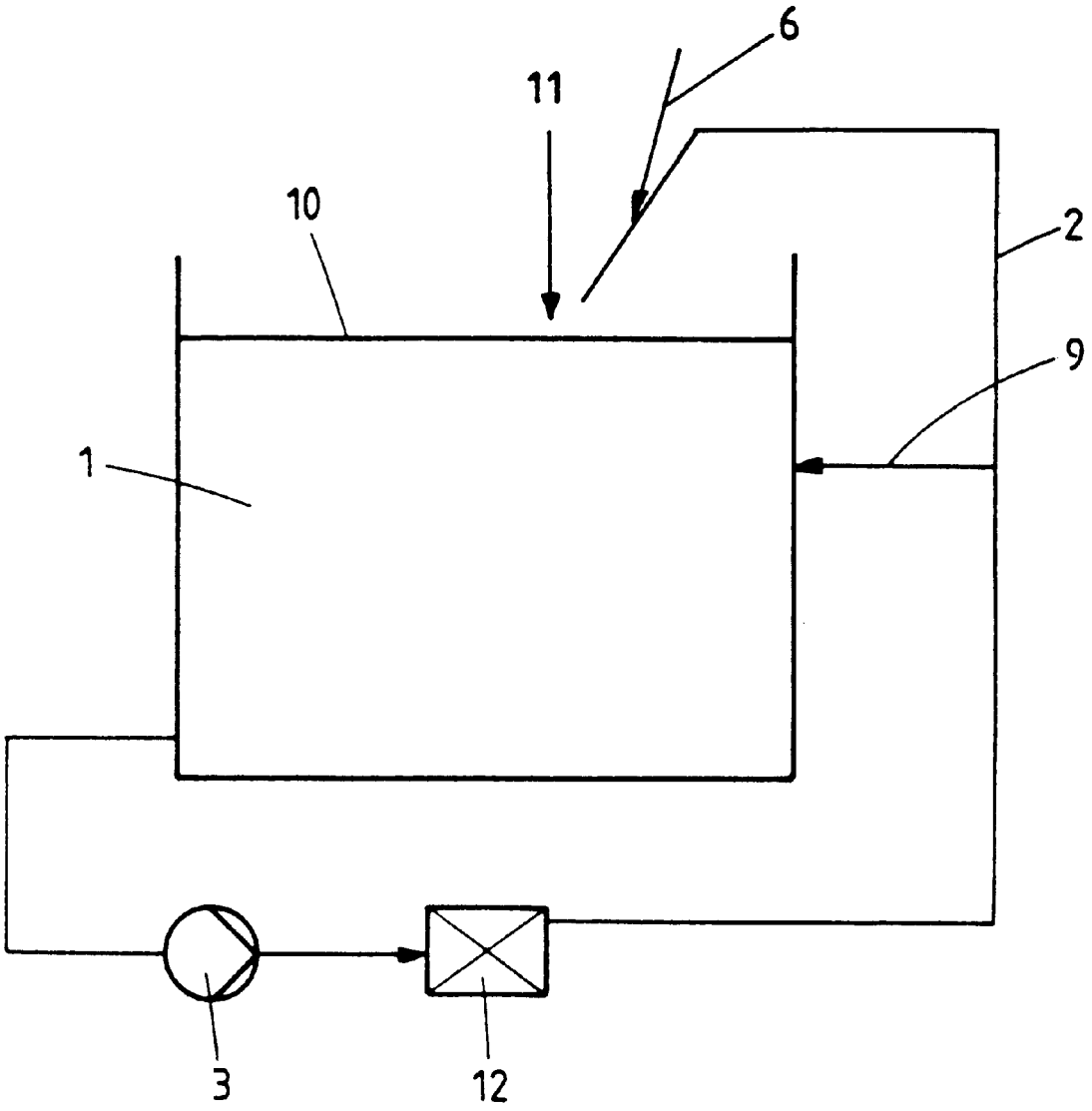

According to FIG. 3, the end of the line (2) here may lie above the surface (10) of the process bath. The distance from the end of the line (2) to the process bath surface (10) here is chosen such that no process bath solution may be sucked back into the line (2). For example, this distance may be in the range of about 10 to about 50 cm. In this embodiment, the process bath solution circulated through the line (2) is thus sprayed on to the surface (10) of the process bath (1), mixing with the remainder of the process bath solution with generation of severe turbulence. The solution to be added is then fed in at that point of the process bath where this severe turbulence prevails. In FIG. 3, this point is indicated with reference symbol (11). The solution to be added may then be fed in, for example, by allowing a line for the solution to be added to end above the surface (10) of the process bath, so that at the point (11), the solution to be added may run out freely on to the surface of the process bath. Because of the high turbulence at this point, the solution to be added mixes rapidly with a large amount of the process bath solution. Accordingly, an embodiment of the process is characterized in that the solution to be added is fed into the process bath at a point where, because of the end of the line (2), vigorous thorough mixing occurs, the end of the line (2) lying above the surface (10) of the process bath.

In one embodiment of the present invention, the process bath solution (1) may be a phosphating solution for phosphating metal surfaces with layer formation or without layer formation. The solution to be added is preferably a basic solution (for example an aqueous solution of sodium hydroxide, sodium carbonate or an alkaline amine solution, for example a solution of hydroxylamine), which is to be mixed with the phosphating bath solution to buffer the free acid. By the addition of this alkaline solution at a point where it mixes rapidly with a large volume of the acid phosphating bath solution as a result of severe turbulence, the formation of phosphating sludge (chiefly zinc phosphate) is largely avoided.

The function of the first line (2) here may be taken over by the line of the heating circulation, and the function of the circulating pump (3) may be taken over by the pump of the heating circulation. The pump of the heating circulation of the process bath is usually constantly active during operation of the unit, and circulates the process bath solution constantly over a heat exchanger (12) (FIG. 3), while pumps for the spraying system in spray installations or circulating pumps in immersion installations may be switched off during pauses or longer interruptions. Accordingly, in one embodiment of the invention, the heating circulation may be constructed such that the process bath solution heated in the heat exchanger (12) is not fed into the process bath below the surface (10) of the process bath, as was conventional hitherto, but the line (2) used for this ends above the surface (10) of the process bath, as described. The solution to be added is then discharged on to the process bath surface at that point (11) where the stream of liquid emerging from the end of the line (2) causes a severe turbulence on the process bath surface. In this embodiment, the process according to the present invention is characterized in that the first line (2) is a heating line for the process bath, via which the solution of the process bath is recycled via a heat exchanger (12) into the process bath.

Depending on the rate of circulation of the process bath solution via the heating circulation (2) of FIG. 3, if the volume stream is too high, undesirably severe splashing could occur at the point where the solution emerging from the end of the line (2) meets the process bath surface. This may be prevented in this embodiment in that the entire volume stream of the heating circulation is not allowed to meet the bath surface through the end of the circulating line (2) lying above the bath surface (10). Rather, a branch line (9) is provided (FIG. 3), through which a part stream of the bath solution circulated in the heating circulation is fed in below the surface of the process bath, and only a further part stream is passed through the end of the line (2) lying above the process bath surface (10). The volume content of process bath solution circulated per unit time which is passed through the branch line (9) directly into the process bath may be adjusted most easily here by the cross-section ratios between the branch line (9) and the part of the circulating line (2) continuing after branching off of this branch line (9). For example, the cross-section ratios may be chosen such that a bath volume of about 1 to about 10 $m^3/h$ is discharged from the end of the line (2) lying above the process bath surface (10) on to the process bath surface.

The flow rate of the process bath solution pumped in circulation at the entry point into the bath may additionally be increased by a nozzle-like narrowing at the tube end of the line (2). As a result, the desired mixing effect on addition of the solution to be added increases. One embodiment of the process according to the present invention is accordingly characterized in that the end of the first line (2) lying above the process bath surface is narrowed like a nozzle and the solution to be added is discharged on to the process bath at a point where, because of the end of the line (2), vigourous thorough mixing occurs.

Figure 1:
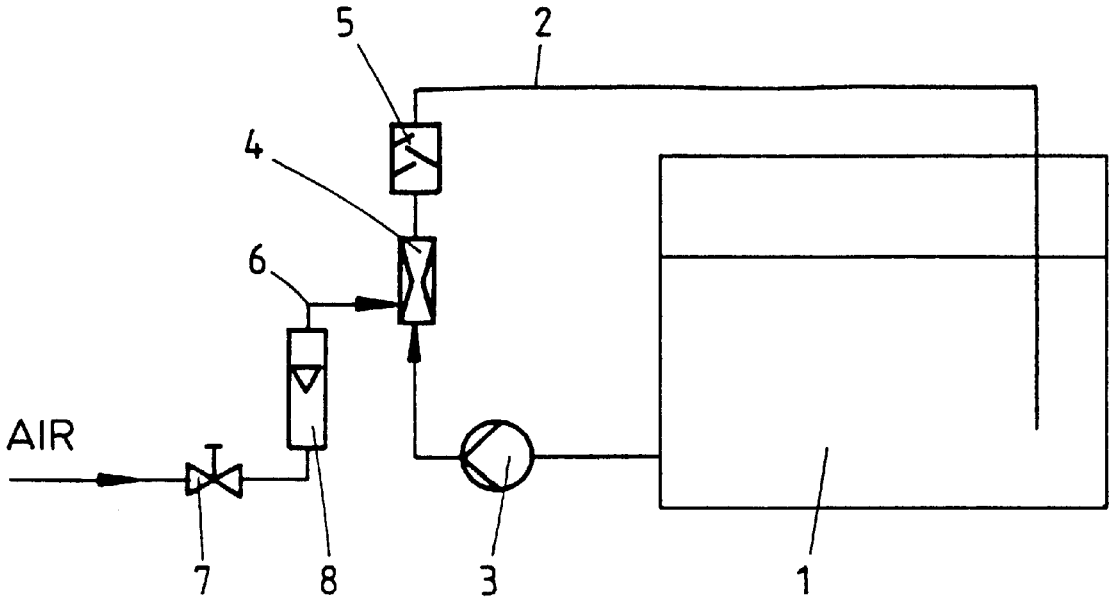
FIGS. 1–3 each show a flow diagram of a different embodiment according to the present invention.
Figure 2:
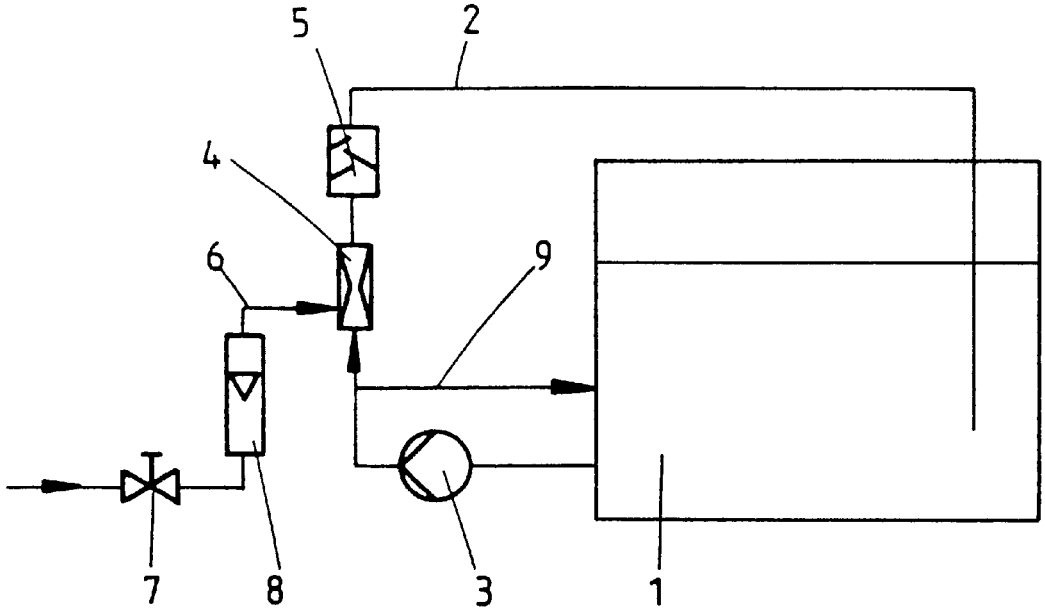

In one embodiment of the present invention in which the end of the first line (2) lies above the process bath surface, a second line (6) (FIG. 3) may join the first line (2) above the end of this line, gas, in particular air, being sucked through this into the first line (2). For this, it is particularly advantageous that the end of the first line (2) narrows like a nozzle, so that because of the increased flow rate, an increased suction effect results, by which gas, in particular air, is sucked into the line (6). The point at which the line (6) joins the circulating line (2) may lie, for example, about 10 to about 50 cm above the end of the line (2). The gas sucked in disperses in the process bath solution circulated through the line (2) and is mixed with this in the process bath. To control the amount of gas sucked in, on the one hand the cross-section of the second line (6) may be chosen accordingly. On the other hand, an adjustable valve, preferably in combination with a flow meter, may be provided, as is illustrated in FIG. 1 and 2.

The embodiments described above, are particularly suitable for process baths (1) which are solutions for phosphating metals with layer formation or without layer formation. The solution to be added is, in particular, an alkaline solution for buffering the free acid, and the gas optionally to be admixed is an oxygen-containing gas, in particular air. Such phosphating bath solutions are described in more detail below.

In another embodiment of the process according to the present invention, the first line (2) is provided with a suction pump (4). The solution to be added and/or the gas to be added may be fed into the line (2) via this suction pump, the solution to be added or the gas to be added already mixing with the process solution within the suction pump and in the subsequent component piece of the line (2).

Two substantial advantages are achieved according to the present invention. Even during topping-up of components in alkaline solution, no sharp local increase in the pH occurs, since the alkaline solution to be added is already mixed with the process solution, for example the acid phosphating solution, before entry into the process bath. In addition to the circulating pump, which is often already present, only small investments are necessary for conversion of known phosphating installations, that is to say an inexpensive suction pump and the appropriate lines.

If the process bath is to be aerated, the expensive use of compressed air and membranes is eliminated, since ambient air may be sucked in via the suction pump and then mixes with the circulated solution in the line. The end of the line dipping into the process bath requires no gas distributor and may therefore be an open pipe end. Although the bubble diameter here is considerably larger than that of the compressed air bubbles emerging from the membranes, this may be compensated by a higher air throughput and/or a longer aeration time without additional costs. The process according to the present invention may be used on process baths with phosphating solutions. The phosphating solutions may serve various industrial purposes. For example, they may be so-called low-zinc phosphating solutions, such as are described, for example, in EP-A-228 151. These have a zinc content of between about 0.3 and about 2 g/l and produce on the substrate zinc phosphate or zinc iron phosphate layers, which may be doped with further metals, such as manganese, and have weights per unit area ("layer weights") in the range from about 1 to about 3 $g/m^2$. Such phosphating solutions are preferably employed to produce phosphate layers which serve as a corrosion-protective adhesive primer for subsequent lacquering, such as cathodic dip-lacquering in vehicle construction. On the other hand, the phosphating solution may be a so-called iron phosphating solution. In contrast to a low-zinc phosphating solution, this contains no heavy metal ions which are incorporated into the phosphate layer. Non-crystalline phosphate and oxide layers having a layer weight of the order of 0.3 to 1.2 $g/m^2$ are deposited on to iron surfaces by treatment with such a phosphating solution. Phosphating solutions which, compared with the low-zinc phosphating solutions, have substantially higher contents of zinc (more than 3 g/l) and, if appropriate, further divalent metals are also known. They produce crystalline phosphate layers having a layer weight significantly above 3 $g/m^2$. These serve as such, or after covering with oils or soaps, as forming aids for forming processes by cold extrusion, such as pipe or wire drawing. Acid manganese phosphate solutions are used to produce slip layers for moving machine parts, such as cylinders.

Phosphating solutions usually comprise so-called accelerators, which contribute towards rapid and uniform formation of the phosphated layer. These are usually oxidizing substances, such as nitrate, nitrite, chlorate and/or hydrogen peroxide. In some cases, as applies, for example, to nitrite and hydrogen peroxide, these are not stable in the acid phosphating solution, so that they cannot be incorporated into a phosphating bath concentrate. Rather, they must be added continuously or discontinuously to the ready-to-use phosphating bath. The process according to the present invention is particularly suitable for such addition.

In the case of phosphating of iron-containing surfaces, divalent iron becomes concentrated in the phosphating bath, and in higher concentrations may interfere with the phosphating process. An excess of iron is usually removed by oxidizing the iron to the trivalent level, so that it precipitates as sparingly soluble phosphate and may be separated from the phosphating solution as phosphating sludge. In addition to the accelerating action, potent oxidizing accelerators additionally fulfil this task. However, if weakly oxidizing accelerators, such as hydroxylamine, are employed, the divalent iron is oxidized to the trivalent level only by contact with atmospheric oxygen and precipitated as phosphate. Intensive contact with air is particularly important for this. A specific process for such an atmospheric oxidation is described, for example, in EP-B-320 798. The process according to the present invention enables the oxidation of divalent iron in a phosphating solution to the trivalent level to be carried out particularly effectively. In this case, an oxygen-containing gas, such as, in particular, ambient air, is fed to the suction pump and brought into intensive contact with the phosphating solution in and after the pump, and in particular in the static mixer preferably located downstream.

The process according to the present invention may be employed not only in phosphating baths, but also in other process baths. Examples which may be mentioned are cooling lubricant tanks and lacquer coagulation baths. Inexpensive aeration is of advantage there, in order to limit the growth of anaerobic bacteria or to kill these bacteria. The aeration according to the present invention may also be employed for neutral cleaning baths for the same purpose.

The process may also advantageously be used for adding oxidizing substances to a pickling solution used, for example, for pickling high-grade steel and/or titanium or alloys thereof. The reduction-oxidation potential required for the pickling and/or passivating step is established or maintained by this means. The process is suitable, for example, for increasing or maintaining the reduction-oxidation potential of a pickling solution such as is described in EP-B-505 606. For this, for example, a solution of an oxidizing agent, such as, in particular, hydrogen peroxide, is added to the process solution via the suction pump. The oxidizing agent has the task of oxidizing the iron(II) and/or titanium(III) formed during the pickling step to the next higher oxidation level. Because of the high turbulence in the suction pump and, in particular, in the static mixer preferably downstream of the immersion pump, this oxidation reaction takes place very rapidly.

It is known from German Patent Application DE 197 55 350.8 to oxidize divalent iron in a pickling solution to the trivalent level by mixing the pickling solution with an oxygen-containing gas, such as, preferably, air, in the presence of copper ions as a catalyst. The process according to the present invention is suitable for carrying out this process, an oxygen-containing gas, preferably ambient air, being sucked in via the suction pump and mixed with the pickling solution.

A suction pump which operates by the Venturi principle and is driven by the circulated solution is preferably employed. A separate drive for the pump is therefore not necessary.

For better mixing of the solution to be added or of the gas to be added with the circulated solution, in an advantageous embodiment of the present invention a static mixer is employed downstream of the suction pump. Like the suction pump which operates by the Venturi principle, the static mixer requires no separate drive. The investment costs for such a mixer are also very low, and this mixer, like the suction pump, may be of a chemicals-resistant design without additional costs.

In another advantageous embodiment of the present invention, the solution to be added or the gas to be added is fed to the suction pump via a second line in which a valve and a flow meter are arranged, so that a controlled and metered addition of gas and solution is possible. In particular, the valve may also be time-controlled, to facilitate continuous maintenance of the desired composition of the process bath. It is also possible and advantageous to include the valve in a control loop comprising sensors for recording the concentrations of components in the process bath. Fully automatic monitoring and topping-up are possible in this way.

In this embodiment, the solution of the process bath is preferably allowed to flow through the first line (2) and, if present, through the suction pump with a throughput of 0.1 to 5 $m^3/h$, in particular 0.5 to 1 $m^3/h$.

If continuous circulation of the process bath liquid with a considerably higher throughput in the circulating line is envisaged, it is proposed to branch off the first line, in which the suction pump is arranged, from the circulation line, in this case the third line. The desired throughput through the first line may be achieved by an appropriate choice of the line diameter and/or by a throttle valve.

Alternatively, the solution and/or gas may also be metered in independently of a bath circulation. For this, it is proposed to feed the solution to be added and/or the gas to be added to a suction pump which operates by the Venturi principle and is driven by a fresh water feed, the solution to be added or the gas to be added mixing with the fresh water.

The present invention also relates to an installation for carrying out the present process, having a container for the process bath and a first line with a circulating pump with which the process bath may be circulated.

In one embodiment, the above-mentioned objects are achieved according to the present invention by a means in which, in the first line, a suction pump which operates by the Venturi principle is provided, to the suction intake of which is connected a second line for a solution to be added and/or a gas to be added. A static mixer is preferably arranged in the first line downstream of the suction pump.

It is furthermore proposed that a valve, in particular a controllable valve, and a flow meter are provided in the second line. The valve here may be controlled by a time switch or may also be part of a control loop, if additional measuring equipment for recording the concentrations in the process bath and control electronics are provided.

In some known installations, circulation of the process bath is already provided, but the flow through the circulation line is often considerably greater than the flow desired for operating the suction pump. In this case, it is favourable if a third line is branched off from the circulating pump and is designed such that the largest proportion of the circulated solution flows through this third line. The smaller proportion of the circulated solution then flows through the suction pump.

In an alternative embodiment, the present invention relates to an installation for carrying out the process according to one or more of claims 2 to 6, having a tank for the process bath (1) and a first line (2) with a circulating pump (3) and a heat exchanger (12), with which the solution of the process bath may be circulated, characterized in that the end of the line (2) lies above the process bath. This embodiment differs from known installations, such as are used, for example, for phosphating metal surfaces with layer formation or without layer formation, in that the line (2) passing over the heat exchanger ends not below the surface (10) of the process bath, but above it. It may additionally be provided that a third line (9) branches off from the first line (2) in the direction of flow downstream of the heat exchanger (12), through which third line a part stream of the circulated solution of the process bath is recycled into the process bath below the bath surface thereof. By choosing different cross-sections for the first line (2) and the third line (9), the proportion of process bath solution circulated via the heat exchanger which is discharged on to the surface of the process bath through the branch line (9) or through the part of the line (2) continuing after the branching off of the branch line (9) may be predetermined.

Two examples are explained in more detail below with the aid of drawings. In the drawings:

FIG. 1 shows a flow diagram of a first embodiment according to the present invention;

FIG. 2 shows a flow diagram of a second embodiment according to the present invention; and FIG. 3 shows a flow diagram of a third embodiment according to the present invention.

In the drawings, the same reference symbols have the same meaning and, where appropriate, are therefore explained only once.

In the example according to FIG. 1, the process bath 1 is aerated. The process bath, having a volume of about 50 to 200 $m^3$, is circulated without interruption via a first line 2 and a circulating pump 3, the circulated stream of liquid being 0.6 $m^3/h$. A suction pump 4 operating by the Venturi principle, e.g. a water pump, and a static mixer 5 are arranged in the first line 2.

To the suction intake of the suction pump 4 is connected a second line 6, through which air is fed via a valve 7 and a flow meter 8.

In the example according to FIG. 2, the solution of the process bath 1 is circulated by means of the circulating pump 3 via a third line 9 with a throughput of 10 $m^3/h$ or more. Via a branching point, some of the circulated solution, that is to say 0.6 $m^3/h$, enters the first line 2 in which the suction pump 4 and the static mixer 5 are arranged. This example otherwise corresponds to the example according to FIG. 1. In the present example according to FIG. 2, however, not only may air be fed to the process bath, but mixing in of liquids, e.g. concentrates for topping-up individual components, is also provided. It is also pointed out that in the example according to FIG. 1, instead of air or in addition to air, it is also possible to feed liquids into the process bath 1 by means of the second line 6.

In the example according to FIG. 3, the first line (2) is the circulating line of the heating circulation. A portion of the process bath solution (1) is pumped in circulation over the heat exchanger (12), and heated as a result, by a pump (3), which lies before the heat exchanger (12) in the direction of flow exemplified in FIG. 3, but could also lie after this heat exchanger. At least a portion of the process bath solution pumped in circulation flows through the end of the circulating line (2), which ends above the surface (10) of the process bath solution (1). A branch line (9) may optionally be provided, through which a part stream of the process bath solution pumped in circulation through line (2) is recycled into the process bath below the bath surface. Reference symbol (6) indicates an optional line, through which a gas may be sucked into the line (2) above the end thereof into the circulated process bath solution, if desired via a regulating valve and/or a flow meter. If this suction line (6) is provided, it is preferably arranged such that its open end comes to lie above the process bath surface. If process bath solution rises back into the gas line (6) due to a breakdown, this arrangement ensures that this process bath solution flows back into the process bath without causing damage. Reference symbol (11) marks the point at which particularly severe turbulence prevails on the surface (10) of the process bath due to arrival of the circulated process bath solution, and where the solution to be added is discharged in one of the embodiments according to the present invention.

List of reference symbols

1 Process bath
2 First line
3 Circulating pump
4 Suction pump

5 Static mixer
6 Second line
7 Valve
8 Flow meter
9 Third line
10 Bath surface
11 Metering point for the solution to be added
12 Heat exchanger

What is claimed is:

1. A process for chemical treatment of a metal surface comprising:

contacting said metal surface with a process bath solution in a container, said process bath solution being comprised of a plurality of components in aqueous solution and having a composition maintained within a given range by addition of at least one solution or gas, wherein said process bath solution is circulated via a first line and a circulating pump and said solution or gas to be added is fed into said process bath solution at a point where vigorous thorough mixing of the solution or gas with the process bath solution occurs, wherein said first line has an end which is above the surface of the process bath solution in the container, wherein a portion of the process bath solution is recycled via a heat exchanger into the process bath and the process includes the step of heating the recycled portion of the process bath solution by means of said heat exchanger.

2. The process of claim 1 wherein the process bath solution being circulated is sprayed onto the surface of the process bath solution in the container with generation of severe turbulence caused by said spraying and said solution or gas to be added is fed in at the point of said severe turbulence.

3. The process of claim 1 wherein a third line, via which a portion of the process bath solution being circulated is recycled into the container, branches off from said first line.

4. The process of claim 1 wherein said end of said first line is narrowed to form a nozzle.

5. The process of claim 1 wherein a second line joins the first line above the end of the first line, wherein a gas is sucked through the second line into the first line.

6. The process of claim 1 wherein the solution or gas to be added is fed to a suction pump in the first line, wherein said solution or gas is mixed with the process bath solution being circulated.

7. The process of claim 6 wherein said suction pump operates by the Venturi principle and is driven by the process bath solution being circulated.

8. The process of claim 6 wherein a static mixer is employed in the first line downstream of the suction pump.

9. The process of claim 6 wherein the solution or gas to be added is fed to said suction pump via a second line in which a valve and a flow meter are arranged.

10. The process of claim 6 wherein the process bath solution being circulated is allowed to flow through the first line with a throughput of 0.1 to 5 $m^3/h$.

11. The process of claim 6 wherein the process bath solution is circulated via a third line which branches off from said first line between the suction pump and the circulating pump.

12. The process of claim 1 wherein the process bath solution is a phosphating solution.

13. The process of claim 1 wherein the process bath solution is a pickling solution for a material selected from the group consisting of high grade steel, titanium, and titanium alloys.

14. The process of claim 1 wherein the solution or gas to be added is air.

15. A process for chemical treatment of a metal surface comprising contacting said metal surface with a process bath solution in a container, said process bath solution being comprised of a plurality of components in aqueous solution and having a composition maintained within a given range by addition of at least one solution or gas wherein said solution or gas to be added is fed to a suction pump which operates by the Venturi principle and is driven by a fresh water feed, said solution or gas to be added mixing with said fresh water feed in the suction pump.

* * * * *